United States Patent [19]

Sor

[11] 4,208,209

[45] Jun. 17, 1980

[54] PROCESS FOR COLD PRESSING FINELY GROUND METALS

[76] Inventor: Kamil Sor, 5 Timberline Dr., Fanwood, N.J. 07023

[21] Appl. No.: 884,420

[22] Filed: Mar. 8, 1978

[51] Int. Cl.[2] ..... B22F 1/04

[52] U.S. Cl. ..... 75/232; 264/111; 264/122

[58] Field of Search ..... 264/111, 122; 75/232

[56] References Cited

U.S. PATENT DOCUMENTS

| | | | |
|---|---|---|---|
| 2,838,802 | 6/1958 | Reynolds et al. | 264/111 |
| 3,871,877 | 3/1975 | Storchheim | 264/111 |

*Primary Examiner*—Robert F. White
*Assistant Examiner*—James R. Hall

[57] ABSTRACT

A method for preparing formed metallic structures involves admixing finely ground metals with a reactive phosphor or iron containing binder and subjecting the resultant mixture to compression.

15 Claims, No Drawings

PROCESS FOR COLD PRESSING FINELY GROUND METALS

BACKGROUND OF THE INVENTION

This invention relates to a method for processing finely ground metals. More particularly, the present invention relates to a method for cold pressing finely ground metals.

During the past two decades, the metallurgical industry has experienced a dramatic increase in growth, such being attributed in large measure to the demanding requirements imposed by interterrestial travel and structural needs.

Heretofore, a wide variety of processing techniques have been utilized to meet these needs. Thus, for example, the sophisticated technologies which embraces the design and fabrication of metallic objects may utilize mechanical shaping or, perhaps, liquefied metals as a vehicle for obtaining a desired metallic configuration. Unfortunately, these technologies have not proven completely satisfactory in that large investments are required from both an equipment energy and practical standpoint, and skilled artisans are deemed essential to obtention of reliability. Moreover, studies have revealed that in effective shaping of metals by means of a conventional heating process the major cost factor arises from maintaining required temperature tolerances during formation. Failure to satisfy such critera often results in the fabrication of brittle objects which are not suited for structural or mechanical applications wherein they commonly encounter stress conditions.

STATEMENT OF THE INVENTION

In accordance with the present invention, these prior art limitations are effectively obviated by a novel processing sequence which eliminates the need for external heating during the forming process. Briefly, the inventive method involves forming an integral solid object by admixing finely ground metals with a reactive binder in powder form and, subsequently, subjecting the resultant mixture to compression.

The process to be described has been found applicable to a wide variety of metals selected from different groups in the Periodic Table of the elements. Of particular interest, however, are copper, iron, silver, aluminum and nickel as well as mixtures thereof. Metals selected for use herein are finely ground and evidence a particle size ranging from 100 microns to 0.1 micron an optimum being found to correspond with minus 50 micron size.

The prime thrust of the instant invention resides in the discovery that chemical compounds such as $P_4$ (amorphous phosphorus), $P_2O_5$ (phosphorous pentoxide), and $Fe_2O_3$ (ferric oxide) serve as reactive binders for the aforementioned metals and mixtures thereof. The binder is employed in fine powder form, that is, in particle size less than 50 microns. Acceleration of the forming process may be effected by addition of trace amounts of water to the binder-metal admixture prior to initiation of compression.

In the operation of the process, the metals selected are first subjected to grinding. This end may be attained by means of any conventional grinding operation utilizing commercial equipment. As noted, particle size of the resultant ground particles should range from 50 to 0.1 microns. Following, phosphorous pentoxide or any other binder listed above which is obtained in fine powder form from commercial sources, is added to the finely ground metals in an amount ranging from 0.1 to 10%, by weight, based on the weight of the ground metals. A preferred range of phorphorous pentoxide added lies between 1 to 3% by weight, based on the total weight of the metals. Next, trace amounts of water are added to the mixture to initiate and accelerate the reaction.

The next step in the inventive process involves compressing the mixture so obtained. For this purpose, a wide variety of commercially available apparatus is suitable. A particularly suitable structure for this purpose is a vertical press with a conventional two-part mold. The metal-binder admixture including trace amounts of water is inserted in the mold of the compression apparatus and subject to pressures ranging from 5,000–20,000 psi or higher, both upper and lower limit being dictated by practical consideration. The density of the compressed product is controlled with an unusual degree of precision by variation in compression levels, density being found to be directly proportional to applied pressure. Compression in accordance with the inventive technique is continued for a time period ranging from 5 seconds to 10 minutes, a preferred range being 1–5 minutes. Following, the molds of the apparatus are parted and the compressed article removed.

An example of the practice of the present invention is set forth below. It will be appreciated by those skilled in the art that the example is for purposes of exposition only and is not to be construed as limiting.

EXAMPLE

Finely ground copper metal having a particle size of minus 325 mesh was admixed with phosphorous pentoxide in an amount such that the ratio of pentoxide to metal was 1:30. Then, a trace amount of water was added to the mixture and cold pressing thereof effected in a vertical press two-part mold at 10,000 psi for 3 minutes. The resultant formed article was next subjected to a temperature of 600° centigrade for quality studies for a period of 3 hours. The product was then cooled to room temperature and studied. The density was 4.880 g/cc (medium density) and the product appeared to be dark grey with no evidence of damage.

The foregoing procedure was repeated with the exception that compression was effected at 20,000 psi. The resultant metal objects were of high density, 6.330 g/cc and evidenced no visible damage after heating.

The foregoing procedure was repeated in several different experiments utilizing from 2–10% by weight of mixture of reactive binder and varying percentages of copper. Aluminum objects were made in certain experiments. Test results indicated that all products so formed were satisfactory from a physical standpoint and were suitable for diverse non-structural purposes.

Experiments were also performed to determine the electrical resistance of aluminum formed in accordance with the present invention (paragraph 1) and these were compared to conventional methods (paragraph 2). Relative resistance values obtained were as follows:

| Metal Type | Relative Resistivity Ohm-cm |
|---|---|
| 1. present invention: | |
| Aluminum with 2% $P_2O_5$ | $92.1 \times 10^{-6}$ |
| Aluminum with 2% $P_4$ | $98.5 \times 10^{-6}$ |
| Aluminum with 2% $Fe_2O_5$ | $84.9 \times 10^{-6}$ |

-continued

| Metal Type | Relative Resistivity Ohm-cm |
|---|---|
| 2. Aluminum metal prepared by conventional methods: | $2.83 \times 10^{-6}$ |

According to these test results aluminum metals prepared in accordance with the method of the present invention had approximately 30 times more electrical resistance than conventinally prepared aluminum metal. This was found to be true also for copper products made under the principles of this invention.

What I claim is:

1. A method for consolidating metal particles into a solid unitary structure which comprises the steps of admixing a finely ground metal composition with from 0.1 to 10% by weight, based on the weight of said composition, of a phosphorous pentoxide reactive binder and subjecting the resultant mixture to compression.

2. The method in accordance with claim 1 wherein the particle size of said ground metal ranges from 100 to 0.1 microns.

3. The method in accordance with claim 1 wherein the reactive binder is in powder form.

4. The method in accordance with claim 1 wherein trace amounts of water are added to said composition prior to compression to initiate and accelerate reaction.

5. The method in accordance with claim 1 wherein compression is effected at a pressure within a range of 5,000 to 20,000 psi.

6. The method in accordance with claim 5 wherein the duration of compression is from 1 to 5 minutes.

7. The method in accordance with claim 1 wherein the reactive binder is employed in an amount from 1 to 3%, by weight, of said composition.

8. The product prepared in accordance with the method of claim 1.

9. A method for consolidating metal particles into a solid unitary structure which comprises the steps of admixing a finely ground metal composition with from 0.1 to 10% by weight, based on the weight of said composition, of an amorphous phosphorus reactive binder and subjecting the resultant mixture to compression.

10. The product prepared in accordance with the method of claim 9.

11. A method for consolidating metal particles into a solid unitary structure which comprises the steps of admixing a finely ground metal composition with from 0.1 to 10% by weight, based on the weight of said composition, of a ferric oxide reactive binder and subjecting the resultant mixture to compression.

12. The product prepared in accordance with the method of claim 11.

13. A method for consolidating metal particles into a solid unitary structure which comprises the steps of grinding the particles until finely ground in a range from 50 to 0.1 microns.

admixing the finely ground metal with from 0.1 to 10% by weight, based on the weight of said metal, of a phosphorus pentoxide reactive binder, and compressing the resultant mixture under a pressure of 5,000 to 20,000 psi to cause all of the particles therein to adhere and become bonded into a solid unitary body.

14. The method in accordance with claim 13 further including the step of mixing trace amounts of water to the resultant mixture prior to compression to initiate and accelerate reaction.

15. The product prepared in accordance with the method of claim 13.

* * * * *